US010138439B2

(12) United States Patent
Huang et al.

(10) Patent No.: US 10,138,439 B2
(45) Date of Patent: Nov. 27, 2018

(54) LUBRICATION MATERIAL USING SELF-DISPERSED CRUMPLED GRAPHENE BALLS AS ADDITIVES IN OIL FOR FRICTION AND WEAR REDUCTION

(71) Applicant: NORTHWESTERN UNIVERSITY, Evanston, IL (US)

(72) Inventors: Jiaxing Huang, Wilmette, IL (US); Qian Wang, Mt. Prospect, IL (US); Yip-Wah Chung, Wilmette, IL (US); Xuan Dou, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 15/281,471

(22) Filed: Sep. 30, 2016

(65) Prior Publication Data

US 2017/0088788 A1 Mar. 30, 2017

Related U.S. Application Data

(60) Provisional application No. 62/235,201, filed on Sep. 30, 2015.

(51) Int. Cl.

| | |
|---|---|
| ***C10M 141/12*** | (2006.01) |
| ***C10M 139/04*** | (2006.01) |
| ***C10M 125/02*** | (2006.01) |

(52) U.S. Cl.

CPC ..... *C10M 141/12* (2013.01); *C10M 125/02* (2013.01); *C10M 139/04* (2013.01);

(Continued)

(58) Field of Classification Search

CPC ..... C10M 125/02; C10M 139/04; C10M 141/12; C10M 2201/041; C10M 2203/022;

(Continued)

(56) References Cited

U.S. PATENT DOCUMENTS

| | | | | |
|---|---|---|---|---|
| 8,227,386 | B2 | 7/2012 | Xiao et al. | |
| 2010/0048435 | A1* | 2/2010 | Yamagata | C10M 169/02 508/172 |

(Continued)

FOREIGN PATENT DOCUMENTS

| | | | |
|---|---|---|---|
| WO | 2012-125854 | A1 | 9/2012 |

OTHER PUBLICATIONS

Korean Intellectual Property Office (ISA/KR), "International Search Report for PCT/US2016/054669", Korea, Jan. 6, 2017.

(Continued)

*Primary Examiner* — James C Goloboy

(74) *Attorney, Agent, or Firm* — Locke Lord LLP; Tim Tingkang Xia, Esq.

(57) ABSTRACT

A method for forming a lubrication material using self-dispersed crumpled graphene balls as additives in a lubricant base fluid for friction and wear reduction. The lubricant base fluid may be, for example, a polyalphaolefin type-4 (PAO4) oil. After the crumpled graphene balls are added as additives in the lubricant base fluid, the lubricant base fluid with the additives are sonicated for a sonicating time period, so that the crumpled graphene balls are self-dispersed in the lubricant base fluid to improve friction and wear properties of the lubricant base fluid. In some cases, a dispersing agent, such as Triethoxysilane, may be added in the lubricant base fluid to enhance stability of dispersion of the crumpled graphene balls in the lubricant base fluid. The crumpled graphene balls may stay stably dispersed in the lubricant base fluid between a lower temperature (such as −15° C.) to a higher temperature (such as 90° C.).

14 Claims, 14 Drawing Sheets

(52) U.S. Cl.
CPC ..... *C10M 2201/041* (2013.01); *C10M 2203/022* (2013.01); *C10M 2227/04* (2013.01); *C10N 2220/082* (2013.01); *C10N 2230/06* (2013.01)

(58) Field of Classification Search
CPC ..... C10M 2227/04; C10N 2220/062; C10N 2230/06
See application file for complete search history.

(56) References Cited

U.S. PATENT DOCUMENTS

2011/0046027 A1* 2/2011 Zhamu ..... C10M 103/02 508/113
2013/0004798 A1* 1/2013 Huang ..... H01M 8/16 429/2
2014/0038862 A1 2/2014 Haque et al.

OTHER PUBLICATIONS

Becton, M. et al., Physical Chemistry Chemical Physics, 2015, pp. 6297-6304, vol. 17, No. 9.
Bakunin, V. N., Suslov, A. Y., Kuzmina, G. N. & Parenago, O. P. Synthesis and application of inorganic nanoparticles as lubricant components—a review. J. Nanopart. Res. 6, 273-284 (2004).
Wang, X.-B. & Liu, W.-M. in Encyclopedia of Tribology, 2369-2376 (Springer, 2013).
Hsu, S. M. Nano-lubrication: concept and design. Tribol. Int. 37, 537-545 (2004).
Bender, J. in Encyclopedia of Tribology (eds Q. Jane Wang & Yip-Wah Chung) Ch. 921, 1355-1359 (Springer US, 2013).
Luo, J. Y., Kim, J. & Huang, J. X. Material Processing of Chemically Modified Graphene: Some Challenges and Solutions. Accounts. Chem. Res. 46, 2225-2234 (2013).
Luo, J. Y. et al. Compression and Aggregation-Resistant Particles of Crumpled Soft Sheets. Acs Nano 5, 8943-8949 (2011).
Luo, J. Y., Jang, H. D. & Huang, J. X. Effect of Sheet Morphology on the Scalability of Graphene-Based Ultracapacitors. Acs Nano 7, 1464-1471 (2013).
Berman, D., Erdemir, A. & Sumant, A. V. Graphene: a new emerging lubricant. Mater. Today 17, 31-42 (2014).
Bollmann, W. & Spreadborough, J. Action of Graphite as a Lubricant. Nature 186, 29-30 (1960).
Huang, H. D., Tu, J. P., Gan, L. P. & Li, C. Z. An investigation on tribological properties of graphite nanosheets as oil additive. Wear 261, 140-144 (2006).
Lee, C. G. et al. A Study on the Tribological Characteristics of Graphite Nano Lubricants. Int. J. Precis. Eng. Man. 10, 85-90 (2009).
Lin, J. S., Wang, L. W. & Chen, G. H. Modification of Graphene Platelets and their Tribological Properties as a Lubricant Additive. Tribol. Lett. 41, 209-215 (2011).
Mungse, H. P. & Khatri, O. P. Chemically Functionalized Reduced Graphene Oxide as a Novel Material for Reduction of Friction and Wear. J. Phys. Chem. C 118, 14394-14402 (2014).
Zhang, W. et al. Tribological properties of oleic acid-modified graphene as lubricant oil additives. J. Phys. D: Appl. Phys. 44 (2011).
Baik S. et al. Frictional Performances of Activated Carbon and Carbon Blacks as Lubricant Additives. Tribol. Trans. 52, 133-137 (2009).
Hardy, W. B. Boundary lubrication—The paraffin series. Proc. R. Soc. London. Sect. A 100, 550-574 (1922).
Udofia I. J. & Jin, Z. M. Elastohydrodynamic lubrication analysis of metal-on-metal hip-resurfacing prostheses. J. Biomech. 36, 537-544 (2003).
Hess, D. P. & Soom, A. Normal Vibrations and Friction under Harmonic Loads .1. Hertzian Contacts. J. Tribol. 113, 80-86 (1991).
Willis, J. R. Hertzian Contact of Anisotropic Bodies. J. Mech. Phys. Solids. 14, 163-& (1966).
Silbert, L. E. Jamming of frictional spheres and random loose packing. Soft Matter 6, 2918-2924 (2010).
Ronen, A. & Malkin, S. Wear Mechanisms of Statically Loaded Hydrodynamic Bearings by Contaminant Abrasive Particles. Wear 68, 371-389 (1981).
Dwyerjoyce, R. S., Sayles, R. S. & Ioannides, E. An Investigation into the Mechanisms of Closed 3-Body Abrasive Wear. Wear 175, 133-142 (1994).
Prabhakaran, A. & Jagga, C. R. Condition monitoring of steam turbine-generator through contamination analysis of used lubricating oil. Tribol. Int. 32, 145-152 (1999).
Hummers, W. S. & Offeman, R. E. Preparation of Graphitic Oxide. J. Am. Chem. Soc. 80, 1339-1339 (1958).
Kim, F. et al. Self-Propagating Domino-like Reactions in Oxidized Graphite. Adv. Funct. Mater. 20, 2867-2873 (2010).
Li, D., Muller, M. B., Gilje, S., Kaner, R. B. & Wallace, G. G. Processable aqueous dispersions of graphene nanosheets. Nat. Nanotech. 3, 101-105 (2008).

* cited by examiner

LUBRICATION MATERIAL USING SELF-DISPERSED CRUMPLED GRAPHENE BALLS AS ADDITIVES IN OIL FOR FRICTION AND WEAR REDUCTION

CROSS-REFERENCE TO RELATED PATENT APPLICATION

This application claims priority to and the benefit of, pursuant to 35 U.S.C. § 119(e), of U.S. provisional patent application Ser. No. 62/235,201, filed Sep. 30, 2015, entitled "SELF-DISPERSED CRUMPLED GRAPHENE BALLS IN OIL FOR FRICTION AND WEAR REDUCTION," by Jiaxing Huang et al., which is incorporated herein by reference in its entirety.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference. In terms of notation, hereinafter, "[n]" represents the nth reference cited in the reference list. For example, [1] represents the first reference cited in the reference list, namely, Bakunin, V. N., Suslov, A. Y. Kuzmina, G. N. & Parenago, O. P. Synthesis and application of inorganic nanoparticles as lubricant components—a review. *J. Nanopart. Res.* 6, 273-284 (2004).

STATEMENT AS TO RIGHTS UNDER FEDERALLY-SPONSORED RESEARCH

This invention was made with government support under N00014-13-1-0556 awarded by the Office of Naval Research. The government has certain rights in the invention.

FIELD OF THE INVENTION

The present invention relates generally to graphene lubrication technology, and more particularly to lubrication materials using self-dispersed crumpled graphene balls in a lubrication oil to improve friction and wear properties of the lubrication oil and grease, methods of forming the same, and applications thereof.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

Lubrication reduces the friction between contacting surfaces and thus increases the energy efficiency of engines and other machines. It can also reduce the degree of wear damage, which increases the life time of the interactive components and prevents catastrophic buildup of wear debris. Many types of nanoparticles have been studied as lubricant additives [1,2], because they offer the ability to enter the contact area between sliding surfaces and protect them from directly rubbing against each other, an ability that small molecular additives lack [2-4]. This makes nanoparticles effective for reducing the so called boundary friction, such as that during the startup of an engine, when the surfaces tend to closely contact each other at a relatively low speed and inflict their most significant wear damage [2-4]. Under such severe friction conditions, the lubricant additives in the contact areas are subject to high local mechanical stresses and sometimes, high temperatures, which can cause molecular modifiers to rub off, decompose, or simply fail to provide a sufficiently thick coverage between the roughened mating surfaces[2-4]. Therefore, nanoparticles are appealing by virtue of their size and their chemical and thermal stability under tribological conditions. However, it is challenging to disperse nanoparticles in lubricating oils. Typically this requires surface functionalization with surfactant-like substances, which themselves are prone to degradation under tribological conditions, leading to unstable lubrication properties for the nanoparticles [2]. Ideally, high performance nanoparticle additives should be able to sustain the chemical and mechanical stresses while remaining dispersed in the lubricant oil.

Therefore, a heretofore unaddressed need exists in the art to address the aforementioned deficiencies and inadequacies.

SUMMARY OF THE INVENTION

One aspect of the present invention relates to a method for forming a lubrication material. In certain embodiments, the method includes: providing a lubricant base fluid; adding crumpled graphene balls as additives in the lubricant base fluid; and sonicating the lubricant base fluid with the additives for a sonicating time period, so that the crumpled graphene balls are self-dispersed in the lubricant base fluid to improve friction and wear properties of the lubricant base fluid.

In certain embodiments, a weight percentage of the crumpled graphene balls to the lubricant base fluid is in a range between 0.01% and 0.1%.

In certain embodiments, the sonicating time period is about 30 minutes.

In certain embodiments, the lubricant base fluid is a polyalphaolefin (PAO) oil.

In certain embodiments, the method further includes: adding a dispersing agent in the lubricant base fluid to enhance stability of dispersion of the crumpled graphene balls in the lubricant base fluid. In one embodiment, the lubricant base fluid is a PAO type-4 (PAO4) oil, and the dispersing agent is Triethoxysilane.

In certain embodiments, the crumpled graphene balls are configured to stay stably dispersed in the lubricant base fluid between a first temperature and a second temperature, wherein the first temperature is lower than a room temperature, and the second temperature is higher than the room temperature. In certain embodiments, the first temperature is about −15° C. and the second temperature is about 90° C. In certain embodiments, the first temperature may go down to the melting/freezing point of the lubricant base fluid.

In certain embodiments, the crumpled graphene balls are formed by isotropically compressing flat graphene-based sheets suspended in nebulized aerosol droplets during a solvent evaporation process.

Another aspect of the present invention relates to a lubrication material, which includes a lubricant base fluid, and crumpled graphene balls being added as additives in the lubricant base fluid. The lubrication material is sonicated for a sonicating time period, so that the crumpled graphene balls are self-dispersed in the lubricant base fluid.

In certain embodiments, a weight percentage of the crumpled graphene balls to the lubricant base fluid is in a range between 0.01% and 0.1%.

In certain embodiments, the sonicating time period is about 30 minutes.

In certain embodiments, the lubricant base fluid is a PAO oil or a mineral oil.

In certain embodiments, the lubrication material further includes: a dispersing agent being added in the lubricant base fluid to enhance stability of dispersion of the crumpled graphene balls in the lubricant base fluid. In one embodiment, the lubricant base fluid is a PAO4 oil, and the dispersing agent is Triethoxysilane.

In certain embodiments, the crumpled graphene balls are configured to stay stably dispersed in the lubricant base fluid between a first temperature and a second temperature, wherein the first temperature is lower than a room temperature, and the second temperature is higher than the room temperature. In certain embodiments, the first temperature is about −15° C. and the second temperature is about 90° C.

In certain embodiments, the crumpled graphene balls are formed by isotropically compressing flat graphene-based sheets suspended in nebulized aerosol droplets during a solvent evaporation process.

Certain aspects of the present invention relate to a method of providing lubrication using the lubrication material as described above, or using the lubrication material formed by the method as described above.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
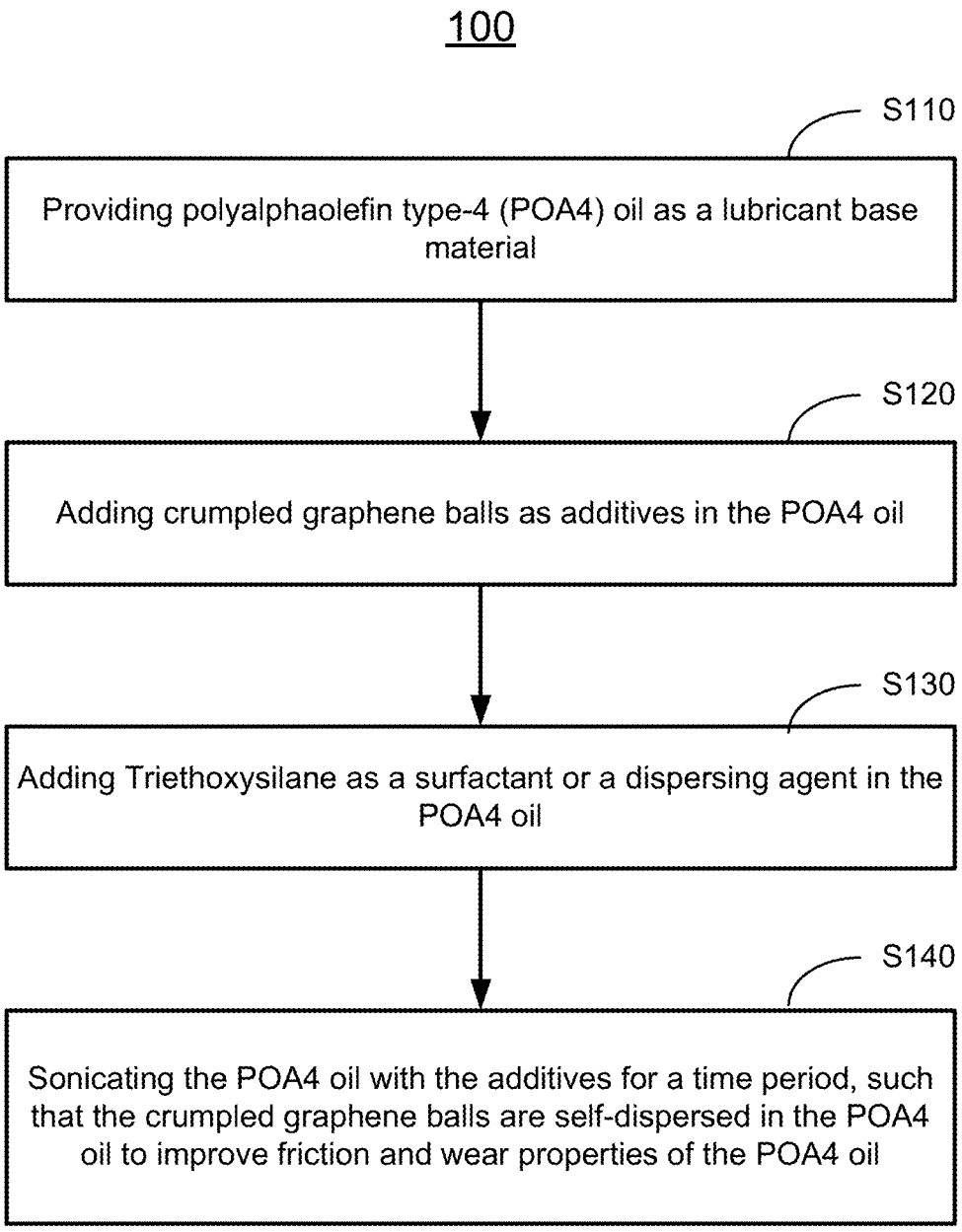
FIG. 1 shows a flowchart of a method for forming a lubrication material according to certain embodiments of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having", or "carry" and/or "carrying," or "contain" and/or "containing," or "involve" and/or "involving, and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about", "substantially" or "approximately" can be inferred if not expressly stated.

As used herein, the phrase "at least one of A, B, and C" should be construed to mean a logical (A or B or C), using a non-exclusive logical OR. It should be understood that one or more operations within a method is executed in different order (or concurrently) without altering the principles of the invention.

Embodiments of the invention are illustrated in detail hereinafter with reference to accompanying drawings. It should be understood that specific embodiments described herein are merely intended to explain the invention, but not intended to limit the invention. In accordance with the purposes of this invention, as embodied and broadly described herein, this invention, in certain aspects, relates to a lubrication material, a method for forming the same, and applications thereof.

As discussed above, nanoparticles are often used as lubricant additives since they are capable of entering the contact area to reduce friction and protect surfaces from wear. Nanoparticles tend to be more stable than molecular additives under the chemical and mechanical stresses during rubbing. It is highly desirable for the nanoparticles to remain well-dispersed in oil under the harsh tribological conditions without relying on molecular ligands. However, it is challenging to disperse nanoparticles in lubricating oils.

Crumpled paper balls have many attractive properties for tribological applications. The pointy surface texture and compact shape of the crumpled paper balls prevent them from sticking to each other or to surfaces, and they can roll and slide with ease. They become strain-hardened (and thus stiffer) under mechanical stress, so they can largely maintain their shapes and their shape-induced nonstick properties [5-7]. In other words, crumpled paper balls can withstand high levels of mechanical compression without fusing to each other or sticking to surfaces. One might expect, then, that ultrafine particles in the shape of paper balls could have superior lubrication properties. Such miniaturized paper balls were first realized with graphene-based materials using an aerosol capillary compression approach [6]. Just as how a paper ball is made by isotropically compressing a sheet of paper with one's hands, the flat graphene-based sheets suspended in nebulized aerosol droplets are isotropically compressed during solvent evaporation, leading to the final crumpled morphology. The resultant sub-micron sized crumpled graphene balls indeed have properties similar to those of the paper balls, including strain hardening and aggregation resistance. The morphology of crumpled graphene balls is highly stable in both the solution and solid states, and they do not unfold or collapse even after heating or pelletizing. Since they are consistently unable to form intimate contact with each other, their interparticle van der Waals attraction is so weak that they can be individually dispersed in nearly any arbitrary solvent, including lubricant oils, without the need for any chemical functionalization. In spite of their compact appearance, crumpled balls have a great deal of free volume and solvent-accessible surface area inside, making them effective absorbers of oil, which could be released upon compression, ensuring uninterrupted wetting of the contact area. These properties should make them highly desirable for tribological applications. Therefore, ultrafine particles resembling miniaturized crumpled balls should self-disperse in oil, and could act like nanoscale ball bearings to reduce the friction and wear.

Certain aspects of the present invention relate to a lubrication material using self-dispersed crumpled graphene balls in a lubrication oil to improve friction and wear properties of the lubrication oil and grease, and a method of forming the same. The crumpled graphene balls are used as a high performance additive that can significantly improve the lubrication properties of the lubrication material, such as the polyalphaolefin oil.

In certain embodiments of the present invention, it is demonstrated that crumpled graphene balls are indeed superior friction modifiers to other common carbon additives including carbon black, graphite powders and chemically exfoliated graphene sheets [8-15]. Remarkably, base oil modified with just 0.01 wt % to 0.1 wt % of crumpled graphene balls is more effective in friction and wear reduction than a fully formulated commercial product made with dozens of additives.

The tribological performance of crumpled graphene balls is insensitive to their concentrations in oil, and readily exceeds that of other common carbon additives such as carbon black, graphite, and reduced graphene oxide. Notably, polyalphaolefin base oil modified with only 0.01 wt % to 0.1 wt % of crumpled graphene balls can already outperform fully formulated commercial lubricant oil in both friction and wear reduction.

Certain aspects of the present invention relate to a lubrication material and a method for forming the same, which use self-dispersed crumpled graphene balls in oil to improve friction and wear properties of the lubricant oil and grease.

In one aspect, the method for forming the lubrication material includes providing a lubricant base fluid; adding crumpled graphene balls as additives in the lubricant base fluid; and sonicating the lubricant base fluid with the additives for a sonicating time period, so that the crumpled graphene balls are self-dispersed in the lubricant base fluid to improve friction and wear properties of the lubricant base fluid. In another aspect, a lubrication material includes a lubricant base fluid and crumpled graphene balls being added as additives in the lubricant base fluid, where the lubrication material is sonicated for a sonicating time period, so that the crumpled graphene balls are self-dispersed in the lubricant base fluid to improve friction and wear properties of the lubricant base fluid. In certain embodiments, a weight percentage of the crumpled graphene balls to the lubricant base fluid is in a range from 0.01 wt % to 0.1 wt %. In certain embodiments, the lubricant base fluid may be a polyalphaolefin (PAO) oil or a mineral oil. In one embodiment, the lubricant base fluid may be a PAO type-4 (PAO4) oil. In certain embodiments, the sonicating time period for the sonicating process may be about 30 minutes. In certain embodiments, a dispersing agent, such as Triethoxysilane, may be added in the lubricant base fluid (such as the PAO4 oil) to enhance stability of dispersion of the crumpled graphene balls in the lubricant base fluid (such as the PAO4 oil).

Certain aspects of the present invention relates to a method of providing lubrication using the lubrication material as stated above or formed by the method stated above.

In certain embodiments, the crumpled graphene balls are formed by isotropically compressing flat graphene-based sheets suspended in nebulized aerosol droplets during a solvent evaporation process.

These and other aspects of the present invention are further described below.

Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

FIG. 1 shows a flowchart of a method for forming a lubrication material according to certain embodiments of the present invention. It should be particularly noted that, unless otherwise stated in the present disclosure, the steps of the method may be arranged in a different sequential order, and are thus not limited to the sequential order as shown in FIG. 1.

As shown in FIG. 1, in step S110, the PAO4 oil is provided as a lubricant base fluid. In certain embodiments, other types of lubricant oil may be used as the lubricant base fluid. In step S120, crumpled graphene balls are added as additives in the PAO4 oil. Optionally, in step S130, Triethoxysilane is added as a surfactant or a dispersing agent in the PAO4 oil to enhance stability of dispersion of the crumpled graphene balls in the PAO4 oil. In certain embodiments, there is no need to provide a surfactant or a dispersing agent in the PAO4 oil. In step S140, the PAO4 oil with the additives (and optionally the surfactant or the dispersing agent) may be sonicated for a sonicating time period, so that the crumpled graphene balls are self-dispersed in the PAO4 oil to improve friction and wear properties of the PAO4 oil. In certain embodiments, the sonicating time period may be 30 minutes.

In order to show that crumpled graphene balls may be more effective as additives in the lubricant base fluid for friction and wear reduction than other types of additives, the inventors have conducted the following experiments as described below.

Dispersion and Aggregation-Resistant Properties of Crumpled Graphene Balls.

The tribological performance of crumpled graphene balls was investigated in comparison to three other widely studied carbon additives: graphite platelets, reduced graphene oxide sheets (r-GO, a.k.a. chemically modified graphene), and carbon black. Powders of these carbon materials (0.01-0.1 wt %) were sonicated in the lubricant base oil (PAO4) until they were fully dispersed with no residual solids remaining.

Figure 2:
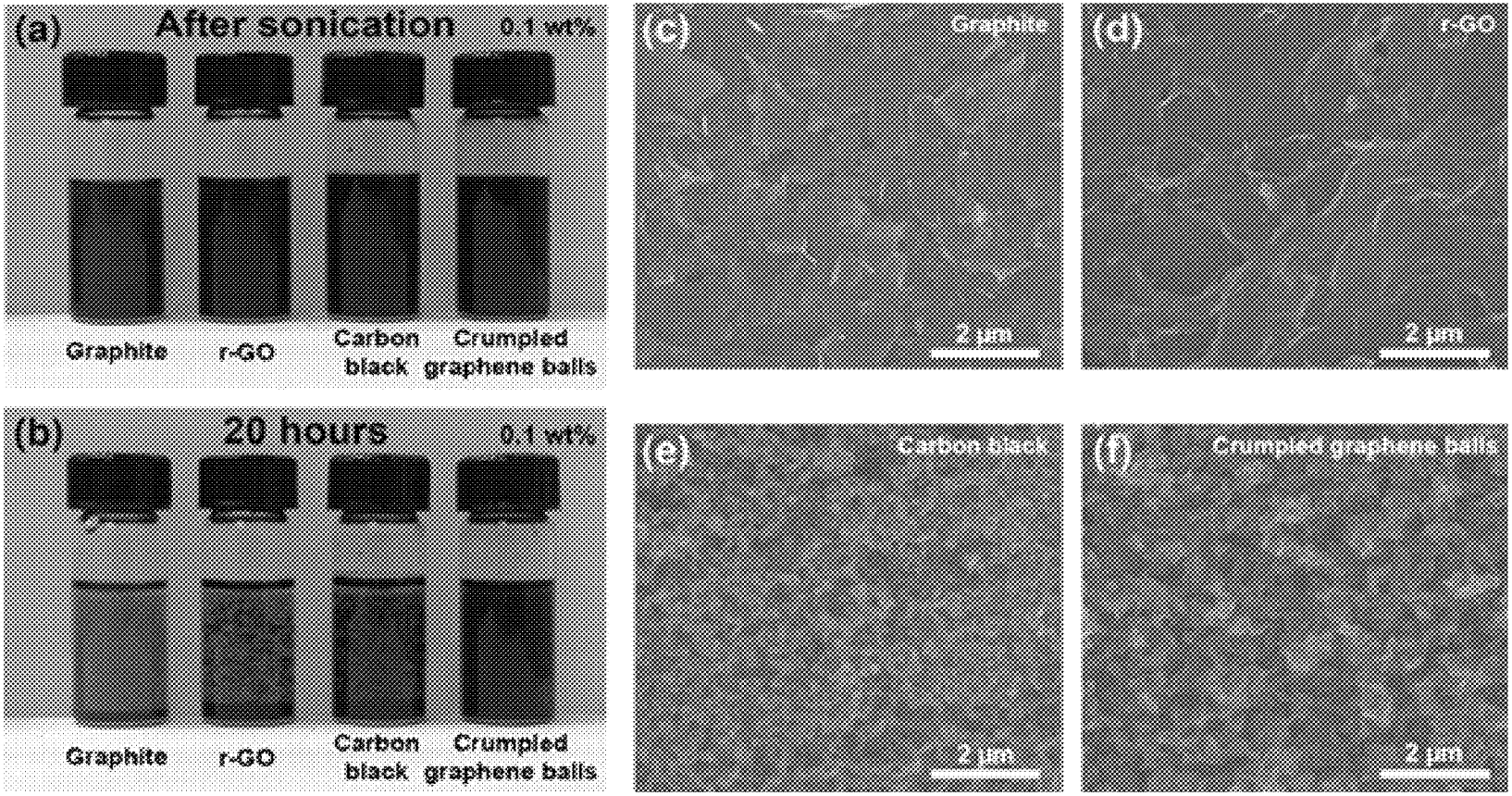
FIG. 2 schematically shows the dispersion properties of four carbon additives in the lubricating oil according to certain embodiments of the present invention, where (a) shows a photo of the four types of carbon additives in PAO4 based oil immediately after sonication; (b) shows a photo of the four types of carbon additives in PAO4 based oil 20 hours after sonication; (c) shows a SEM image of powders of graphite; (d) shows a SEM image of powders of r-GO; (e) shows a SEM image of powders of carbon black; and (f) shows a SEM image of powders of crumpled graphene balls.

FIG. 2 schematically shows the dispersion properties of four carbon additives in the lubricating oil according to certain embodiments of the present invention, where (a) shows a photo of the four types of carbon additives in PAO4 based oil immediately after sonication; (b) shows a photo of the four types of carbon additives in PAO4 based oil 20 hours after sonication; (c) shows a SEM image of powders of graphite; (d) shows a SEM image of powders of r-GO; (e) shows a SEM image of powders of carbon black; and (f) shows a SEM image of powders of crumpled graphene balls. The solid content for all the dispersions is 0.1 wt %. As shown in FIG. 2(*a*), all four additives can initially disperse in the base oil right after sonication. However, agglomeration was apparent in the dispersions of graphite platelets, r-GO sheets and carbon black powders after a few hours. As shown in FIG. 2(*b*), after 20 hours, the crumpled graphene balls were still dispersed in the oil, but the other three carbon materials were fully sedimented. The crumpled graphene balls stay dispersed due to their aggregation-resistant properties.

The microstructures of the four carbon additives are observed with the scanning electron microscope (SEM). As shown in FIG. 2(*c*), the sonicated graphite platelets are typically around 1-3 microns in lateral dimension and 40-60 nm in thickness. Although they disperse initially, they are prone to aggregation due to their flat, disk-like shape, which can form intimate inter-particle contact and generate strong attraction. Similarly, as shown in FIG. 2(*d*), the r-GO sheets also tend to restack to form large chunks a few hours after sonication. As shown in FIG. 2(*e*), the primary particles in carbon black powders are about 50 nm in diameter, and they aggregate into micron-sized clusters, which can be broken down to sub-micron pieces by sonication. Therefore, carbon black powders can stay dispersed for about 5-10 hours. Further, as shown in FIG. 2(*f*), the crumpled graphene balls are around 500 nm in diameter, and the dispersion of the crumpled graphene balls was most stable, because their shape prevents them from forming tight stacking, hence preventing aggregation. After a few days, all the dispersed carbon additives as shown in FIGS. 2(*a*) and 2(*b*) will sediment in the oil. Upon shaking, sedimented graphite platelets, r-GO sheets and carbon black powders can re-disperse in oil. However, having already aggregated, they will precipitate again quickly.

Figure 3:
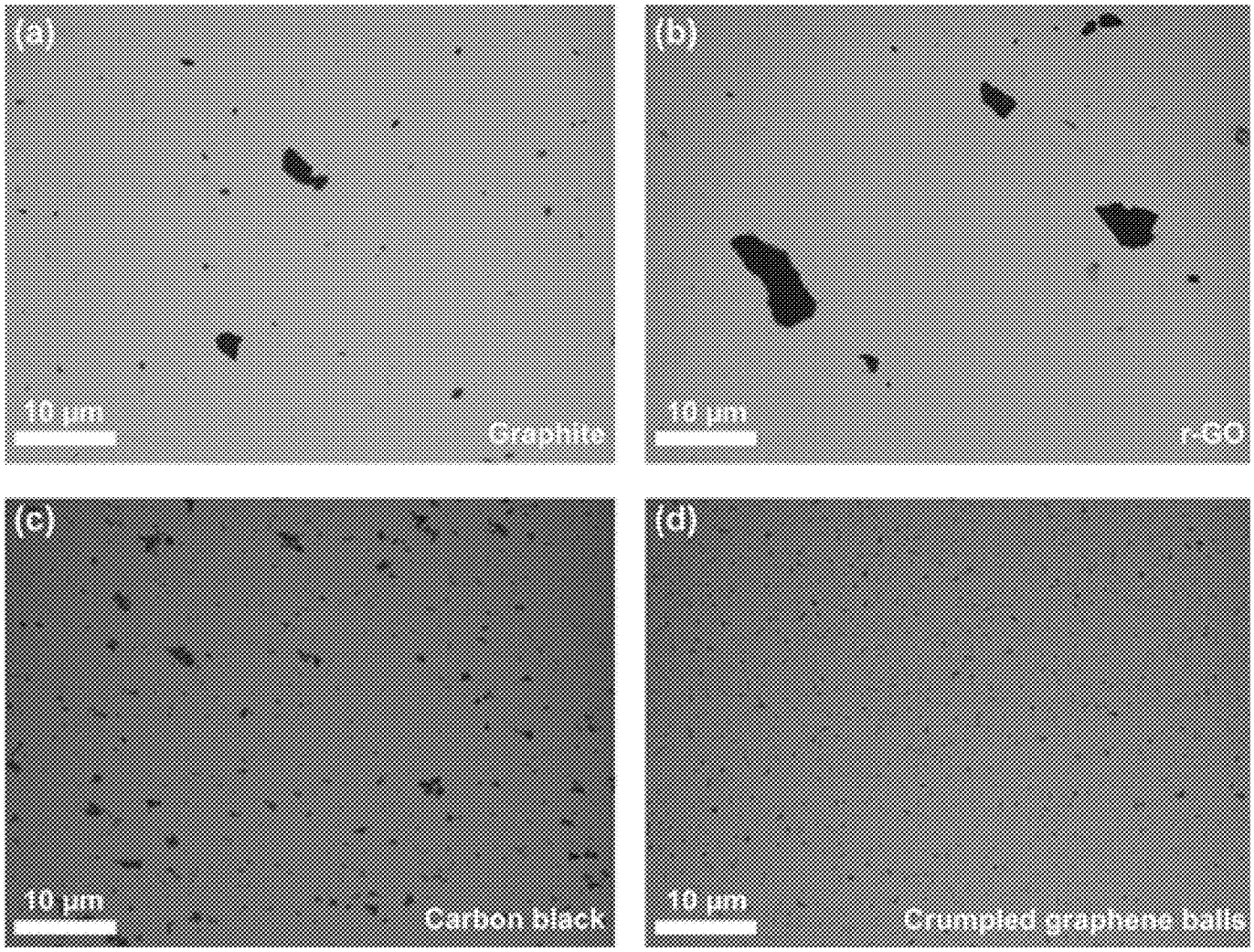
FIG. 3 shows optical microscopy images corresponding to the vials as shown in FIG. 2(*a*) according to certain embodiments of the present invention, where (a) shows graphite powders, (b) shows r-GO powders, (c) shows carbon black powders, and (d) shows crumpled graphene balls.

FIG. 3 shows optical microscopy images corresponding to the vials as shown in FIG. 2(*a*) according to certain embodiments of the present invention, where (a) shows graphite powders, (b) shows r-GO powders, (c) shows carbon black powders, and (d) shows crumpled graphene balls. All the scale bars are 10 μm. As shown in FIG. 3(*a*)-(*c*), the graphite, r-GO and carbon black powders all form large aggregates with uneven sizes in the PAO4 base oil, while FIG. 3(*d*) shows that crumpled graphene balls are much more finely dispersed. In other words, optical microscopic observation of the shaken oil samples as shown in FIG. 3 reveals that of the four samples, only crumpled graphene balls can be finely redispersed, while the other three oil samples contained large, persistent micron-sized aggregates.

Figure 4:
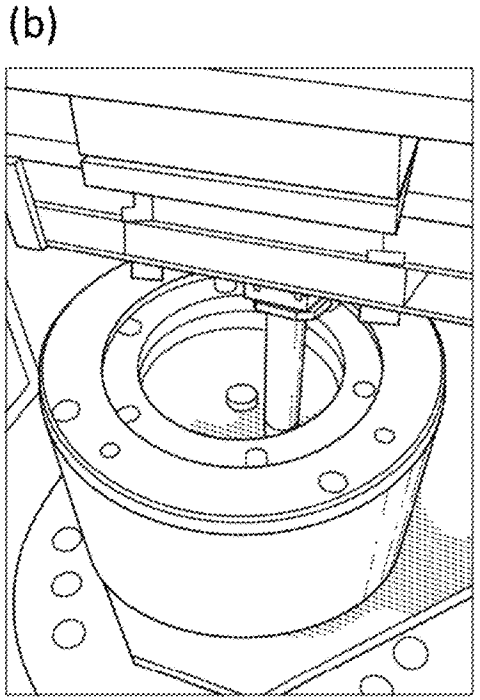
FIG. 4 shows (a) a schematic view and (b) a photo of a pin-on-disk configured tribometer used for testing the tribological properties of the carbon-based additives in PAO4 base oils according to certain embodiments of the present invention.
Figure 4:
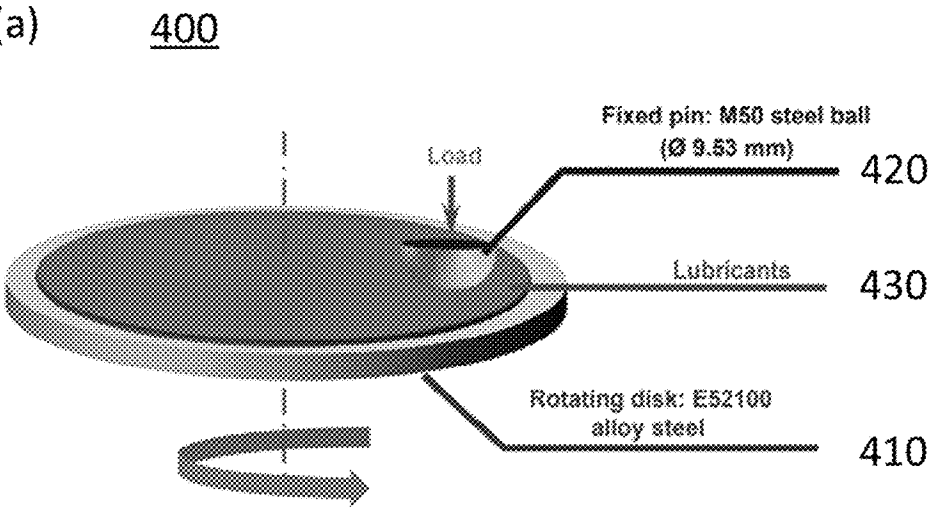

FIG. 4 shows (a) a schematic view and (b) a photo of a pin-on-disk configured tribometer used for testing the tribological properties of the carbon-based additives in PAO4 base oils according to certain embodiments of the present invention. As shown in FIG. 4, a pin-on-disk configured tribometer was used to study the tribological properties of the carbon-based additives in PAO4 base oils [15-16]. As shown in FIG. 4(*a*), the pin-on-disk configured tribometer 400 includes a disk 410 and a pin 420, and the lubricants (i.e., the lubricant base fluid with additives) are disposed on the disk 410 as a film 430 so that the lubricant film 430 will be used for lubrication purposes between the disk 410 and the pin 420. In the experiment, the pin 420 was made of M50 steel ball (Ø 9.53 mm, surface roughness Ra about 17 nm), and the disk 410 was made of E52100 steel (Ø 30 cm, Ra about 5 nm), respectively [16,17]. In order to keep the tribological test in the boundary lubrication regime, testing parameters were chosen to ensure that the thickness of the lubricant film 430 was smaller than the surface roughness [17]. According to the Hamrock-Dowson equation [18], this condition can be met by applying a 10 N load to the pin while the disk is rotating at 10 mm/s. The maximum Hertzian contact pressure was about 1 GPa [19,20].

Figure 5:
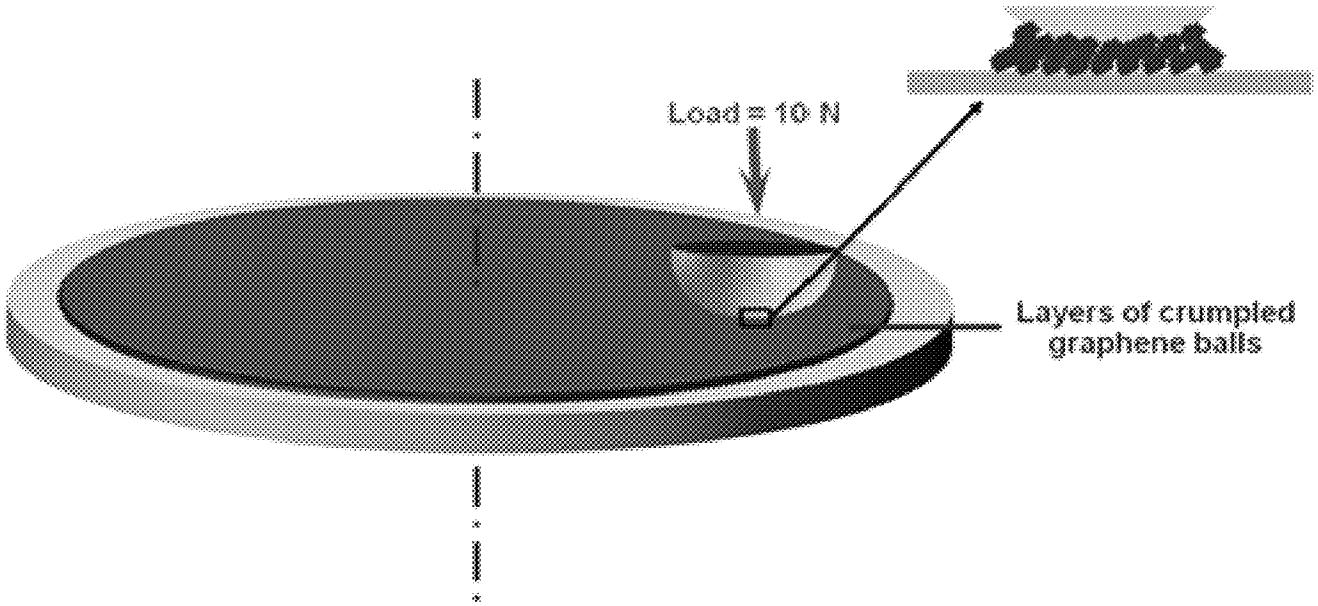
FIG. 5 schematically shows showing crumpled graphene balls being compressed between the pin and the disk on a pin-on-disk type of tribological tester according to certain embodiments of the present invention.

In order to test whether the crumpled graphene balls can retain their round shapes under such a high pressure, static compression experiments were performed first by using the same pin-on-disk configuration with a 10 N load. FIG. 5 schematically shows showing crumpled graphene balls being compressed between the pin and the disk on a pin-on-disk type of tribological tester according to certain embodiments of the present invention. As shown in FIG. 5, the load on the pin was set to be 10 N, and crumpled graphene balls drop-casted onto a polished steel disk formed a uniform film. The steel ball left a nearly circular contact area of around 300 μm in diameter.

Figure 6:
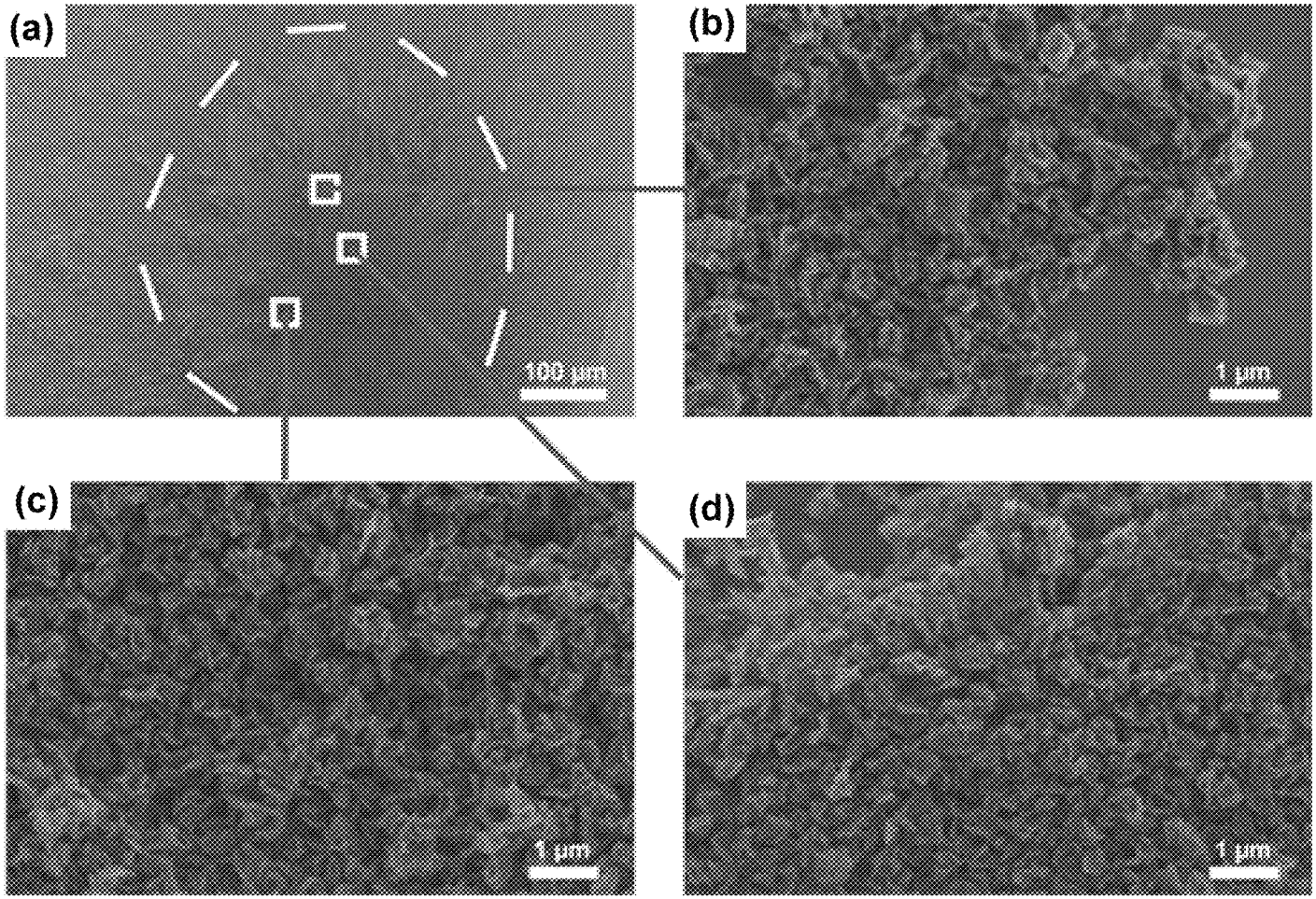
FIG. 6 shows (a) a SEM overview image of the area of crumpled graphene coated disk right beneath the pin as shown in FIG. 5, and (b), (c) and (d) respectively show high magnification images taken on the residues within the contact area of (a), according to certain embodiments of the present invention.

FIG. 6 shows (a) a SEM overview image of the area of crumpled graphene coated disk right beneath the pin as shown in FIG. 5, and (b), (c) and (d) respectively show high magnification images taken on the residues within the contact area of (a), according to certain embodiments of the present invention. The white dashed line as shown in FIG. 6(*a*) outlines the contact area of the pin. As shown in FIG. 6(*a*), the SEM overview image of this area shows that some particles or patches of crumpled graphene balls were removed with the ball by the pin after the test, exposing the surface of the steel disk. However, the crumpled graphene balls remaining in the contact area did not appear flattened or severely deformed, as shown in FIGS. 6(*b*), (*c*) and (*d*). In other words, the residues within the contact area show no apparent shape change or deformation after compression.

Crumpled graphene balls' resistance to compression is attributed to their strain-hardening property. The aerosol-assisted capillary crumpling process created folds within the crumples, which helps to strengthen the structure. Upon further compression by the ball, more folds can be generated, leading to increased stiffness. The results as shown in FIG. 6 suggest that crumpled graphene balls should be able to survive the harsh tribological conditions while remaining dispersible during lubrication.

Self-Dispersed Crumpled Graphene Balls as Friction Modifiers.

Figure 7:
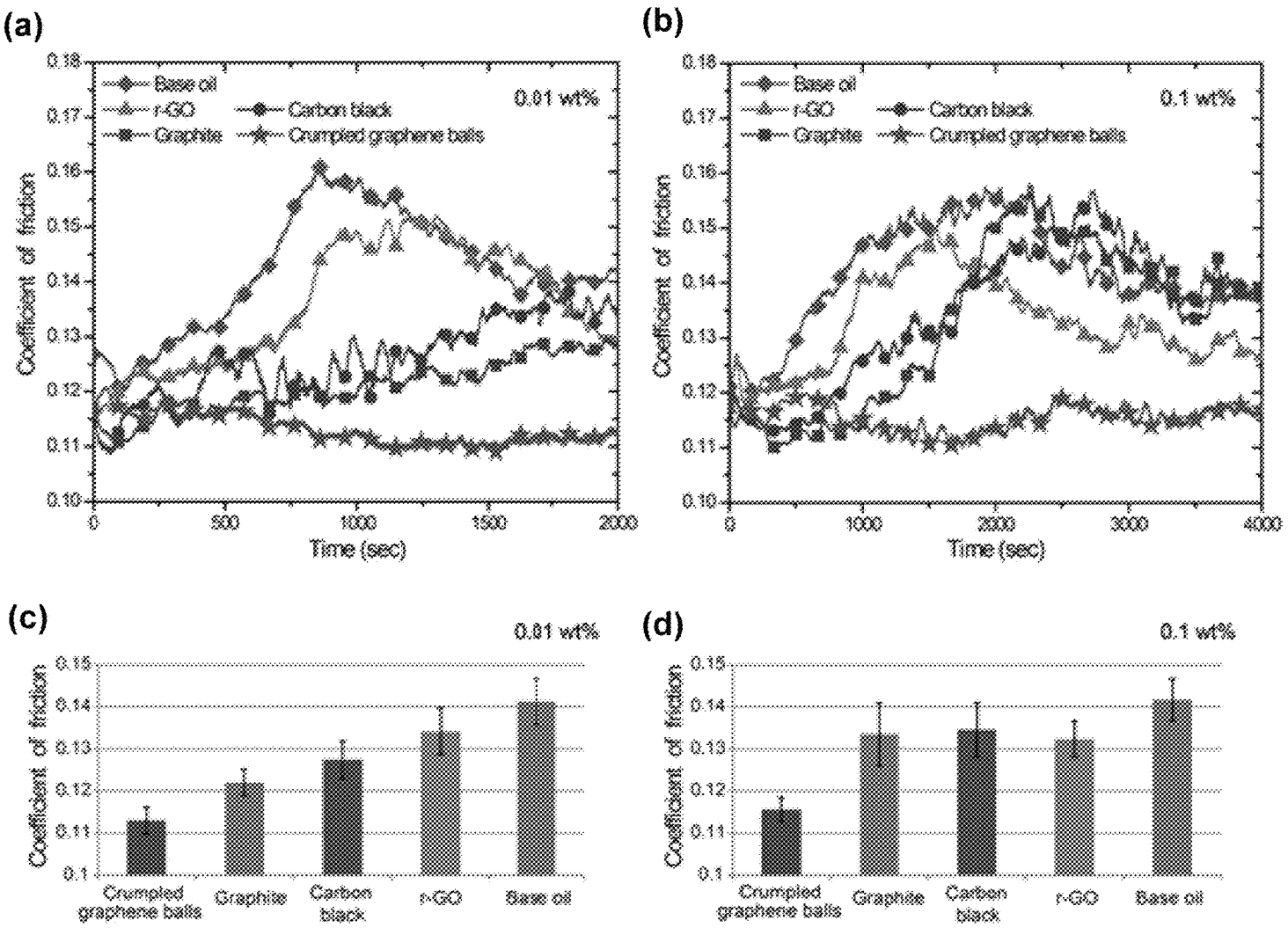
FIG. 7 shows coefficient of frictions of the PAO4 base oil with and without the carbon additives according to certain embodiments of the present invention, where (a) shows time evolving coefficient of frictions measured for the base oil itself and samples with 0.01 wt % additives; (b) shows time evolving coefficient of frictions measured for the base oil itself and samples with 0.1 wt % additives; (c) shows a bar chart of the average values of the coefficient of frictions as shown in (a); and (d) shows a bar chart of the average values of the coefficient of frictions as shown in (b).

FIG. 7 shows coefficient of frictions of the PAO4 base oil with and without the carbon additives according to certain embodiments of the present invention, where (a) shows time evolving coefficient of frictions measured for the base oil itself and samples with 0.01 wt % additives; (b) shows time evolving coefficient of frictions measured for the base oil itself and samples with 0.1 wt % additives; (c) shows a bar chart of the average values of the coefficient of frictions as shown in (a); and (d) shows a bar chart of the average values of the coefficient of frictions as shown in (b). Specifically, the friction test results as shown in FIG. 7 indicated that for both concentrations, crumpled graphene balls are found to be the most effective carbon additives for friction reduction.

As shown in FIG. 7(*a*), steel surfaces lubricated with the unmodified oil display a peak in the friction coefficient as the mating surfaces were rubbing each other. Therefore, direct contact of surfaces is responsible for the initial increase of friction coefficient increase. The later decrease is attributed to increased surface area of interaction and reduced pressure due to formation of wear tracks. The friction curve for r-GO is similar to that of the base oil, indicating that agglomerated particles cannot effectively reduce the coefficient of friction. The other three additives meanwhile experience relatively good dispersion at low concentration, leading to improved lubrication. However, crumpled graphene particles lead to the lowest friction coefficient among all the additives.

In practice, a good solid additive should maintain consistent performance over a range of solid concentrations, so that local concentration fluctuations and/or material loss do not disrupt the functionality of the additive. Therefore, tests were also conducted at higher solids loading, 0.1 wt %, as shown in FIG. 7(*b*). For this high concentration test, graphite, carbon black, and r-GO all fail to effectively lubricate, and, like the base oil, they all display pronounced running-in before settling at higher friction values. In this more concentrated situation, the materials more easily aggregate. These large, poorly dispersed aggregates cannot fill in the wear track and cannot protect or separate the metal surfaces. Meanwhile, aggregates could induce jamming in the friction test, leading to increases in the friction coefficient [21]. By contrast, crumpled graphene balls keep the tribological tests smoothly with stable and significantly lower coefficients of friction even at a higher concentration, as shown in FIGS. 7(*a*) and (*b*). Self-dispersion and aggregation-resistant properties are primarily responsible for this consistently low friction over this range of concentration.

Figure 8:
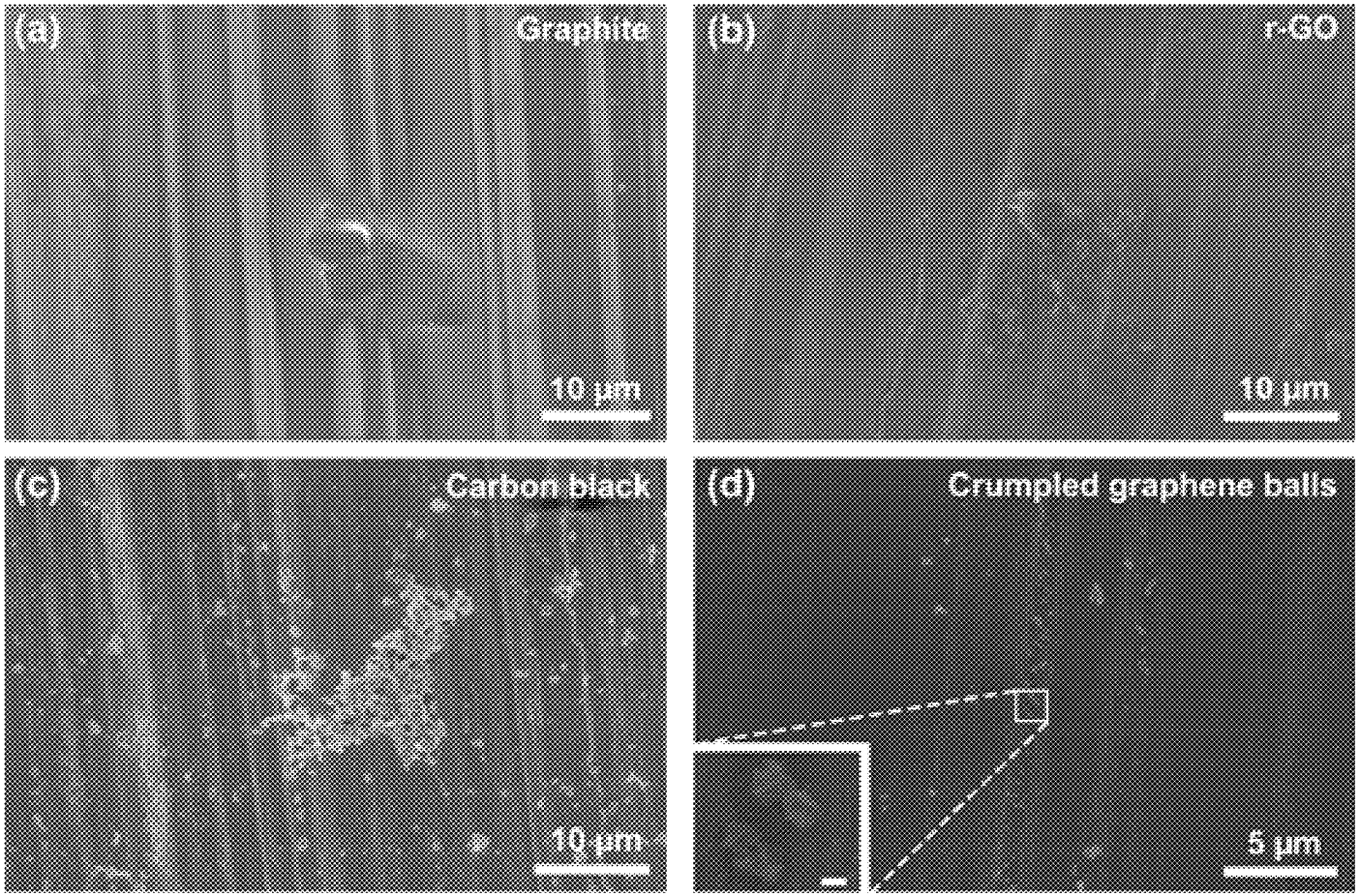
FIG. 8 shows SEM images showing the carbon additives in the wear tracks after tribological tests according to certain embodiments of the present invention, where (a) shows graphite, (b) shows r-GO, (c) shows carbon black and (d) shows crumpled graphene balls sheets.

After the friction tests, the wear surfaces were imaged by SEM. Some carbon-based particles were left on the wear track. FIG. 8 shows SEM images showing the carbon additives in the wear tracks after tribological tests according to certain embodiments of the present invention, where (a) shows graphite, (b) shows r-GO, (c) shows carbon black and (d) shows crumpled graphene balls sheets. Severe aggregation is observed for all carbon-based additives, as shown in FIGS. 8(*a*), (*b*) and (*c*), except crumpled graphene balls as shown in FIG. 8(*d*). In other words, only crumpled graphene balls remain aggregation-free. Intact crumpled graphene balls can be seen filling the grooves of the wear tracks and are separated from each other clearly. Evidently, the stain-hardening property of crumpled nanostructure prevents excessive shape deformation and damage during friction. Impressively, only 0.01 wt % crumpled graphene additives is needed to reduce the friction coefficient of the base oil by 20%, as shown in FIG. 7(*c*).

Wear Reduction by Self-Dispersed Crumpled Graphene Balls

In addition to the substantial friction reduction, noteworthy improvements in wear reduction are also observed in the friction experiments. As shown in FIG. 8, SEM images of the wear tracks already suggest that oil modified with crumpled graphene balls is qualitatively more effective at reducing wear than any other carbon additive. Quantitative examination of the wear tracks was conducted with white light interferometer, which generated a 3D map of the surface.

Figure 9:
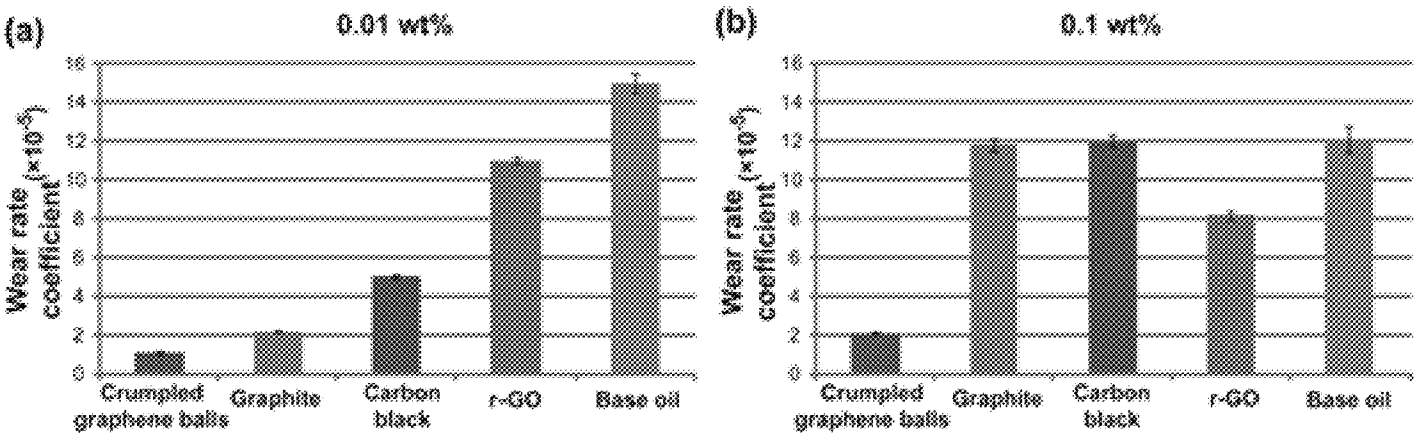
FIG. 9 shows bar charts of wear rate coefficients of the PAO4 based oil with and without carbon additives according to certain embodiments of the present invention, where (a) shows a bar chart for 0.01 wt % additives, and (b) shows a bar chart for 0.1 wt % additives.
Figure 10:
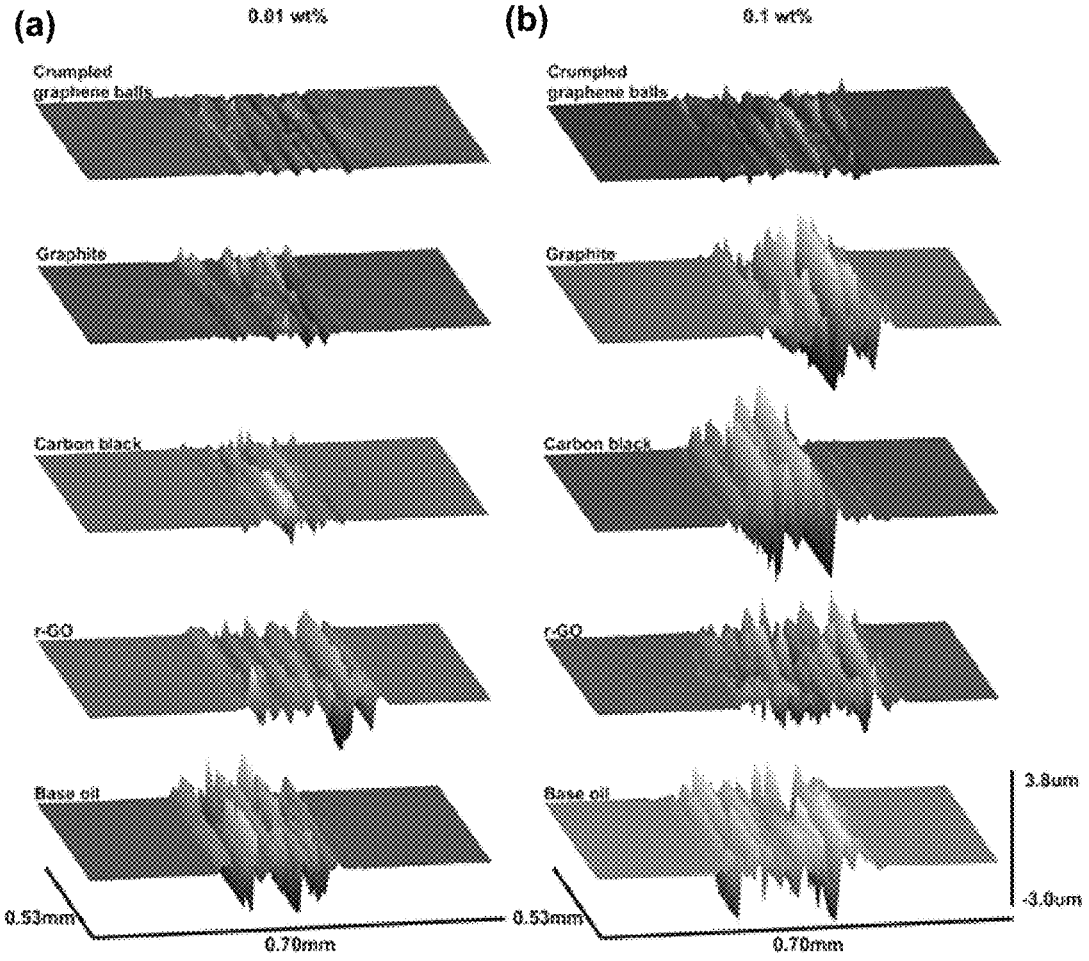
FIG. 10 shows corresponding 3D profile images of the wear tracks of the PAO4 based oil with and without carbon additives according to certain embodiments of the present invention, where (a) shows a bar chart for 0.01 wt % additives, and (b) shows a bar chart for 0.1 wt % additives.

FIG. 9 shows bar charts of wear rate coefficients of the PAO4 based oil with and without carbon additives according to certain embodiments of the present invention, where (a) shows a bar chart for 0.01 wt % additives, and (b) shows a bar chart for 0.1 wt % additives. FIG. 10 shows corresponding 3D profile images of the wear tracks of the PAO4 based oil with and without carbon additives according to certain embodiments of the present invention, where (a) shows a bar chart for 0.01 wt % additives, and (b) shows a bar chart for 0.1 wt % additives. It is evident that crumpled graphene balls can better protect the steel surface from wear. As shown in FIG. 9, for both 0.01 and 0.1 wt %, crumpled graphene balls are significantly more effective than other carbon additives for wear reduction. The apparent wear coefficient difference in pure base oil between the two tests arises from the different testing times, because the most significant wear tends to occur at the beginning of the test, the wear coefficient calculated from the longer test should be lower. Further, r-GO sheets, which did not reduce the coefficient of friction greatly (see FIG. 7), also failed to provide effective wear reduction; it showed the same apparent decrease in wear coefficient as the base oil when tested at a higher concentration for a longer time. Similar to what was observed for friction coefficients, the wear reduction performances of graphite platelets and carbon black additives also degrade at higher concentrations. Meanwhile, varying the concentrations has comparatively little effect on the wear coefficients for the lubricant with crumpled graphene balls.

Figure 11:
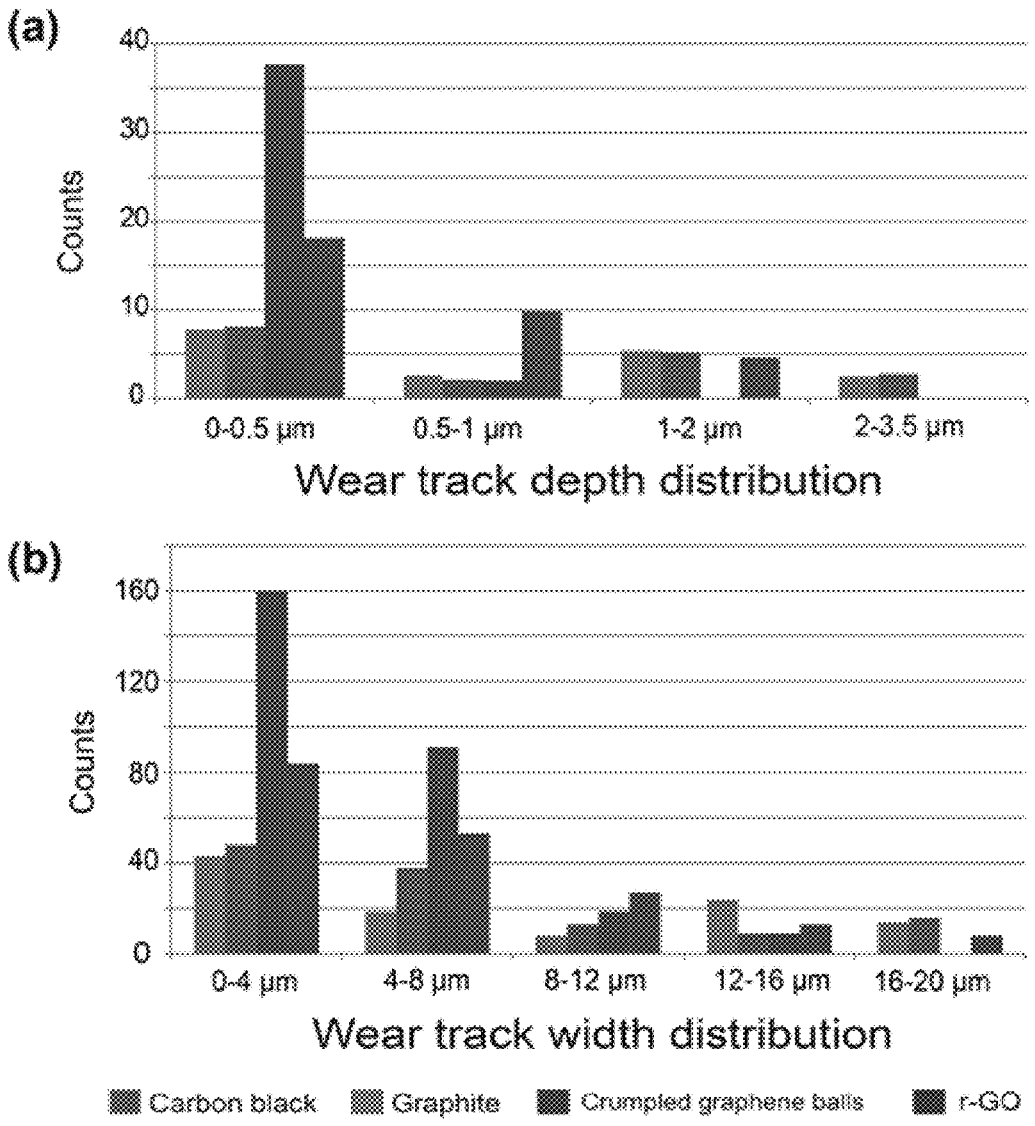
FIG. 11 shows (a) width and (b) depth distribution of wear tracks as shown in FIG. 10(*b*) according to certain embodiments of the present invention.

FIG. 11 shows (a) width and (b) depth distribution of wear tracks as shown in FIG. 10(*b*) according to certain embodiments of the present invention. In particular, FIG. 11 presents a detailed analysis of the wear tracks as shown in FIG. 10(*b*). Compared to the other three additives, the crumpled graphene balls generated shallower (0-0.5 μm), narrower (0-4 μm), and more uniform wear tracks. In contrast, wear tracks generated by other carbon additives are much deeper (1-3.5 μm) and wider (12-20 μm), with a broader size distribution. It is significant that the use of crumpled graphene particles prevents the formation of wear tracks larger or deeper than 10 μm, because such wear tracks tend to generate large debris that can inflict server abrasive type of wear [22-24]. Compared to the use of the base oil, the self-dispersed crumpled graphene additives are able to eliminate wear by about 85% (see FIG. 9).

Benchmarking Against Fully Formulated Commercial Lubricant.

The base oil modified with 0.1 wt % crumpled graphene balls was also tested for comparison with a polyalphaolefin-based commercial lubricant 5W30.

Figure 12:
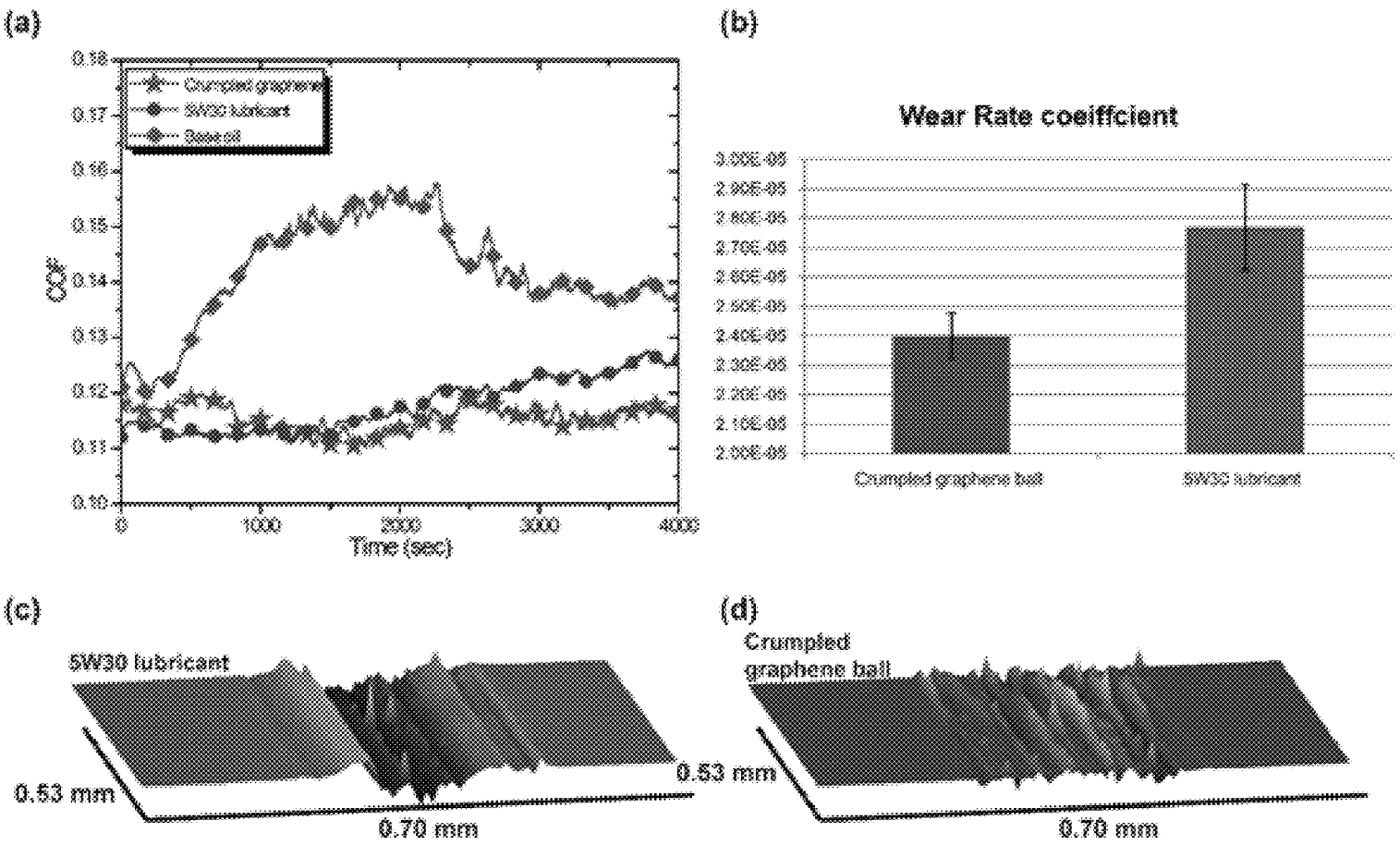
FIG. 12 shows comparison of the PAO4 base oil modified by crumpled graphene balls and the fully formulated lubricant 5W30 (additives up to 10 wt %) according to certain embodiments of the present invention, where (a) shows coefficient of frications, (b) shows a bar chart of the wear rate coefficients, (c) shows a 3D profile image of the wear tracks of the 5W30 lubricant, and (d) shows a 3D profile image of the wear tracks of the PAO4 base oil modified by crumpled graphene balls.

FIG. 12 shows comparison of the PAO4 base oil modified by crumpled graphene balls and the fully formulated lubricant 5W30 (additives up to 10 wt %) according to certain embodiments of the present invention, where (a) shows coefficient of frications, (b) shows a bar chart of the wear rate coefficients, (c) shows a 3D profile image of the wear tracks of the 5W30 lubricant, and (d) shows a 3D profile image of the wear tracks of the PAO4 base oil modified by crumpled graphene balls. As shown in FIG. 12(*a*), both 5W30 and crumpled-graphene-ball-modified PAO4 outperform the base oil, with comparable coefficients of friction. The lubricant 5W30 has organic molecular friction modifiers which bind to the metal surface and decrease adhesion, making it effective for friction reduction. However, crumpled graphene balls are more capable of wear reduction, as shown in FIG. 12(*b*). The difference is evidently revealed by the wear track profiles as shown in FIGS. 12(*c*) and (*d*). As shown in FIG. 12(*c*), the surface lubricated by 5W30 still yielded deep and wide wear tracks at tens of micron scale. However, crumpled graphene balls can provide better protection of the surfaces, leaving a much smoother wear track, as shown by the profile in FIG. 12(*d*). In other words, at 0.1 wt % of loading level, the PAO4 base oil modified by crumpled graphene balls outperforms the fully formulated lubricant 5W30 (additives up to 10 wt %).

Materials and Methods

Materials

In the experiments as discussed above, graphite was purchased from Sigma-Aldrich. Carbon black was purchased from VWR. Lubricant PAO4 base oil was purchased from Exxon-Mobil. The steel disks for friction tests were machined from an E52100 steel bar, and the disk surfaces were machine-polished to a mirror finish with surface roughness Ra of around 5 nm measured by an interferometer. The steel balls, ⅜" in diameter and made of MO50 bearing steel, were purchased from McMaster-Carr and used as received. GO was made by a modified Hummers method [25] as described previously [5,26]. An ultrasonic atomizer (1.7 Mhz, UN-511 Alfesa Pharm Co., Japan) was used to generate aerosol droplets of aqueous graphene oxide solution at a concentration of 1.5 mg/mL. Nitrogen flow was used to carry those droplets through a 400° C. tube furnace. Particles were collected at the end of the tube furnace using a Millipore Teflon filter with 200 nm pore size [6]. Those partially reduced crumpled GO particles were further reduced at 700° C. in argon for an hour. Reduced graphene oxide (r-GO) was synthesized by hydrazine reduction of GO in water and collected by filtration based on a previous report [27].

Tribology Tests

Lubricant additives (graphite, carbon black and crumpled graphene balls) were added to the PAO4 base oil (density=0.82 g/ml) and sonicated for 30 minutes in a water-bath ultrasonic cleaner UC-32D, 125W. Due to its poor dispersibility, the filtered r-GO was tip sonicated (150W) for 10 min before sonicating in a water bath for 20 min. Before testing, the polished 52100 steel disks and steel ball were sonicated in acetone for 5 minutes to remove any possible residual contaminants. Then, the metal disk was fixed tightly in the holder of the tribotester, and plastic pipettes were used to transfer 3 mL of freshly mixed lubricant solution onto the disk. The tests were conducted at a linear speed of 10 mm/s, a constant vertical force of 10 N (about 1 GPa of max Hertzian contact pressure), and ambient temperature and humidity. The experimental duration was 2000 s and 4000 s respectively for the 0.01 wt % and 0.1 wt % concentration of each nanomaterial additive. Each sample was tested for at least twice under identical conditions.

Characterization of Wear Tracks

Before each SEM observation, the metal disk was cleaned in hexane for 3 minutes to remove the residual lubricant oil, and was then air dried. SEM images were recorded using a LEO 1525 microscope. Before optical profilometry, the steel disk was further sonicated in acetone to completely remove all the debris and lubricant materials. A Zygo® NewView™ 7300 optical surface profiler was used to identify and analyze the 3D topography of the wear track. The wear volume was defined as the amount of metal removed from a single track in the course of an experiment, and was estimated by numerically integrating the surface height (from optical profilometry) over the area at eight different points along the track. Wear coefficient is given by using the equation below:

$$\text{Wear rate coefficient (K)} = \frac{\text{Wear volume (m}^3\text{)} \times \text{Surface hardness (Pa)}}{\text{Normal load (N)} \times \text{Sliding distance (m)}}$$

Vickers hardness measurements of steel disks were determined to be 575 kgf/mm$^2$ (5.639 Gpa) by a Struers Duramin microhardness tester. The measurements were repeated three times for each disk.

Dispersion Test of Modified Oil at Low and High Temperatures

In cold weather or regions, mechanical parts, like the engine, need cold start under very low temperature (e.g., −15° C.). Once the engine operates, mechanical parts would operate at the relatively high temperature (90° C.). And lubricant additive should be able to stay as stable dispersion in the oil under these extreme temperatures.

1. Dispersion Test of Crumpled Graphene Balls at Low Temperature (−15° C.)

Figure 13:
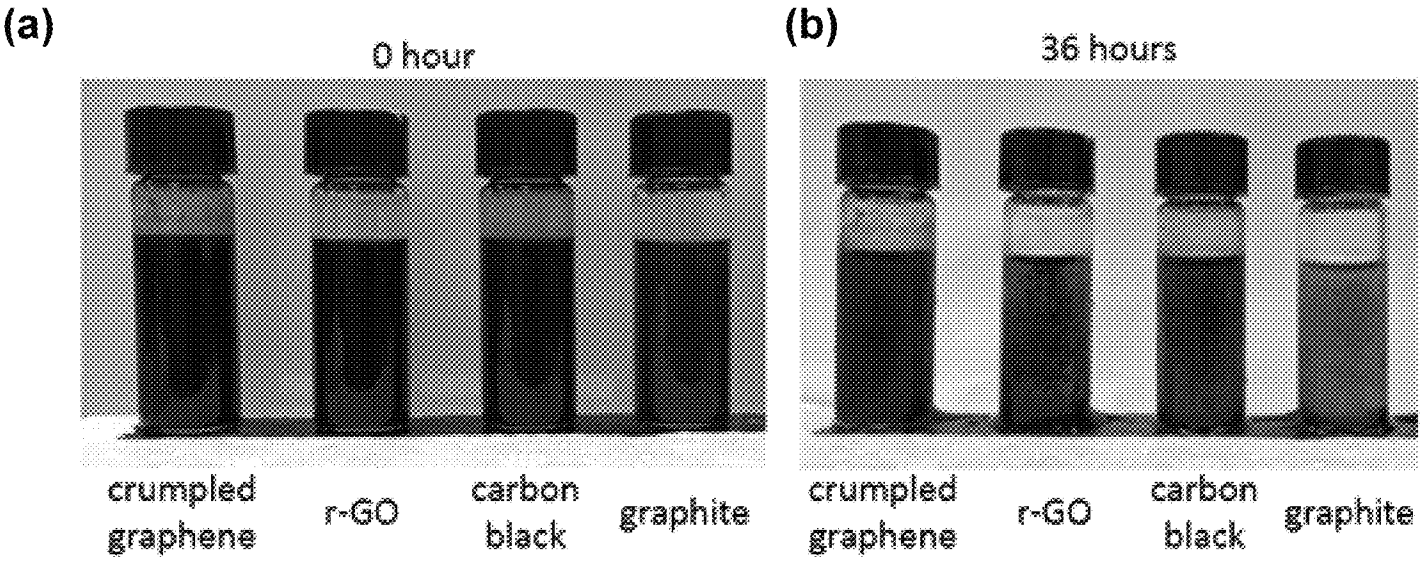
FIG. 13 shows the dispersion properties of four carbon additives in the lubricating oil at a low temperature of −15° C. according to certain embodiments of the present invention, where (a) shows a photo of the four types of carbon additives in PAO4 based oil disposed in the low temperature environment immediately, and (b) shows a photo of the four types of carbon additives in PAO4 based oil disposed in the low temperature environment for 36 hours.

FIG. 13 shows the dispersion properties of four carbon additives in the lubricating oil at a low temperature of −15° C. according to certain embodiments of the present invention, where (a) shows a photo of the four types of carbon additives in PAO4 based oil disposed in the low temperature environment immediately, and (b) shows a photo of the four types of carbon additives in PAO4 based oil disposed in the low temperature environment for 36 hours. In particular, FIG. 13 shows oil dispersions of crumpled graphene balls, graphene (reduced graphene oxide, r-GO) sheets, carbon black and graphite plates at the low temperature of −15° C. As shown in FIG. 13(*b*), after 36 hours, the oil dispersion of crumpled graphene particles still remains stable. In comparison, the dispersion of r-GO, carbon black and graphite all had obvious precipitation.

2. Dispersion Test at High Temperature

Although crumpled graphene balls can disperse in PAO4 without surfactant, adding a surfactant or dispersing agent can further enhance their stability, especially at higher temperature.

Figure 14:
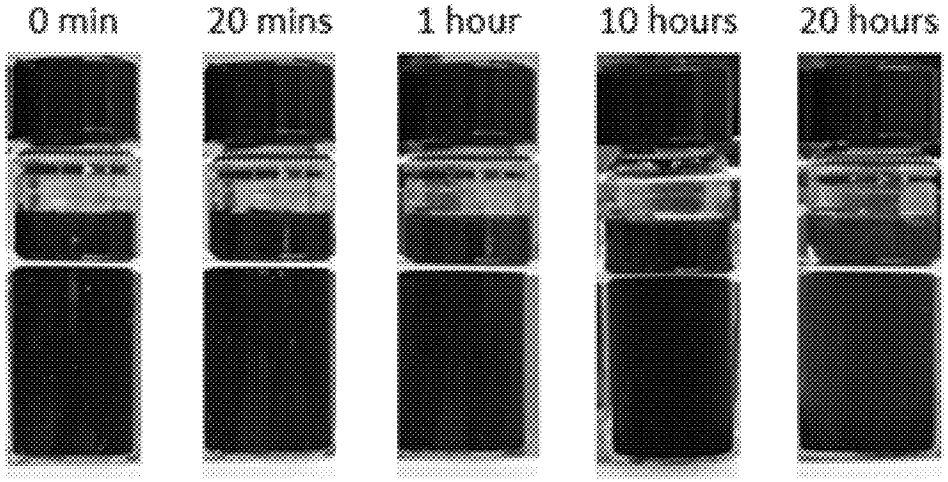
FIG. 14 shows the dispersion properties of four carbon additives in the lubricating oil at a high temperature of 90° C. according to certain embodiments of the present invention.

FIG. 14 shows the dispersion properties of four carbon additives in the lubricating oil at a high temperature of 90° C. according to certain embodiments of the present invention. In particular, FIG. 14 shows a dispersion of crumpled graphene balls in PAO4 oil with a dispersing agent (e.g., Triethoxysilane), immersed in hot PAO4 oil heated at 90° C.

Accordingly, in certain embodiments, the crumpled graphene balls may stay stably dispersed in the lubricant base fluid between a first temperature of about −15° C. and a second temperature of about 90° C. In certain embodiments, the first temperature may go down to the melting/freezing point of the lubricant base fluid.

In summary, the crumpled graphene balls have a superior lubricant property due largely to their anti-aggregation property. This unique property makes them more stable in lubricant oil solution than chemically similar materials, such as graphite, carbon black, and r-GO. Crumpled graphene balls are more effective than any other materials tested in this work in friction and wear reduction. Aggregation makes other nanomaterials studied lose their ability to prevent the contact of two surfaces, negatively impact the friction and wear. In contrast to other carbon additives, whose tribological properties vary drastically with their concentrations, crumpled graphene balls deliver consistently high performance. It was found that crumpled graphene balls are able to reduce friction coefficient and wear coefficient by about 20% and 85% respectively with respect to the base oil. Furthermore, base oil modified with crumpled graphene balls alone outperform a fully formulated 5W30 lubricant in terms of friction and wear reduction. The combination of aggregation resistance, self-dispersion, and mechanical properties of crumpled graphene particles makes them an attractive material for tribological applications.

In sum, certain aspects of the present invention relate to methods of using self-dispersed crumpled graphene balls in oil to improve friction and wear properties of the lubricant oil and grease, and applications thereof. Ultrafine nanoparticles are often used as lubricant additives since they are capable of entering the contact area to reduce friction and protect surfaces from wear. They tend to be more stable than molecular additives under the chemical and mechanical stresses during rubbing. It is highly desirable for the nanoparticles to remain well-dispersed in oil under the harsh tribological conditions without relying on molecular ligands. Crumpled paper balls can withstand high levels of mechanical compression without fusing to each other or sticking to surfaces. Therefore, ultrafine particles resembling miniaturized crumpled balls should self-disperse in oil, and could act like nanoscale ball bearings to reduce the friction and wear. In certain embodiments, crumpled graphene balls may be used as a high performance additive that can significantly improve the lubrication properties of polyalphaolefin oil. The tribological performance of crumpled graphene balls is insensitive to their concentrations in oil, and readily exceeds that of other common carbon additives such as carbon black, graphite, and reduced graphene oxide. Notably, polyalphaolefin base oil modified with only 0.01 wt % to 0.1 wt % of crumpled graphene balls can already outperform fully formulated commercial lubricant oil in both friction and wear reduction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

LIST OF REFERENCES

[1]. Bakunin, V. N., Suslov, A. Y., Kuzmina, G. N. & Parenago, O. P. Synthesis and application of inorganic nanoparticles as lubricant components—a review. *J. Nanopart. Res.* 6, 273-284 (2004).

[2]. Wang, X.-B. & Liu, W.-M. in *Encyclopedia of Tribology,* 2369-2376 (Springer, 2013).

[3]. Hsu, S. M. Nano-lubrication: concept and design. *Tribol. Int.* 37, 537-545 (2004).

[4]. Bender, J. in *Encyclopedia of Tribology* (eds Q. Jane Wang & Yip-Wah Chung) Ch. 921, 1355-1359 (Springer US, 2013).

[5]. Luo, J. Y., Kim, J. & Huang, J. X. Material Processing of Chemically Modified Graphene: Some Challenges and Solutions. *Accounts. Chem. Res.* 46, 2225-2234 (2013).

[6]. Luo, J. Y. et al. Compression and Aggregation-Resistant Particles of Crumpled Soft Sheets. *Acs Nano* 5, 8943-8949 (2011).

[7]. Luo, J. Y., Jang, H. D. & Huang, J. X. Effect of Sheet Morphology on the Scalability of Graphene-Based Ultracapacitors. *Acs Nano* 7, 1464-1471 (2013).

[8]. Berman, D., Erdemir, A. & Surnant, A. V. Graphene: a new emerging lubricant. *Mater. Today* 17, 31-42 (2014).

[9]. Bollmann, W. & Spreadborough, J. Action of Graphite as a Lubricant. *Nature* 186, 29-30 (1960).

[10]. Huang, H. D., Tu, J. P., Gan, L. P. & Li, C. Z. An investigation on tribological properties of graphite nanosheets as oil additive. *Wear* 261, 140-144 (2006).

[11]. Lee, C. G. et al. A Study on The Tribological Characteristics of Graphite Nano Lubricants. *Int. J. Precis. Eng. Man.* 10, 85-90 (2009).

[12]. Lin, J. S., Wang, L. W. & Chen, G. H. Modification of Graphene Platelets and their Tribological Properties as a Lubricant Additive. *Tribol. Lett.* 41 209-215 (2011).

[13]. Mungse, H. P. & Khatri, O. P. Chemically Functionalized Reduced Graphene Oxide as a Novel Material for Reduction of Friction and Wear. *J. Phys. Chem. C* 118, 14394-14402 (2014).

[14]. Zhang, W. et al. Tribological properties of oleic acid-modified graphene as lubricant oil additives. *J. Phys. D: Appl. Phys.* 44 (2011).

[15]. Baik, S. et al. Frictional Perfoiinances of Activated Carbon and Carbon Blacks as Lubricant Additives. *Tribol. Trans.* 52, 133-137 (2009).

[16]. Hardy, W. B. Boundary lubrication—The paraffin series. *Proc. R. Soc. London. Sect, A* 100, 550-574 (1922).

[17]. Bhushan, B. Boundary Lubrication. *Encyclopedia of Nanotechnology,* 354-362 (2012).

[18]. Udofia, L J. & Jin, Z. Aft Elastohydrodynamic lubrication analysis of metal-on-metal hip-resurfacing prostheses. *J. Biomech.* 36, 537-544 (2003).

[19]. Hess, D. P. & Soom, A. Normal Vibrations and Friction under Harmonic Loads 1. Hertzian Contacts. *J. Tribol.* 113, 80-86 (1991).

[20]. Willis, J. R. Hertzian Contact of Anisotropic Bodies. *J. Mech. Phys. Solids.* 14, 163-& (1966)

[21]. Silbert, L. E. Jamming of frictional spheres and random loose packing. *Soft Matter* 6, 2918-2924 (2010).

[22]. Ronen, A. & Malkin, S. Wear Mechanisms of Statically Loaded Hydrodynamic Bearings by Contaminant Abrasive Particles. *Wear* 68, 371-389 (1981).

[23]. Dwyerjoyce, R. S., Sayles, R. S. & Ioannides, E. An Investigation into the Mechanisms of Closed 3-Body Abrasive Wear. *Wear* 175, 133-142 (1994).

[24]. Prabhakaran, A. & Jagga, C. R. Condition monitoring of steam turbine-generator through contamination analysis of used lubricating oil. *Tribol. Int.* 32, 145-152 (1999).

[25]. Hummers, W. S. & Offeman, R. E. Preparation of Graphitic Oxide. *J. Am. Chem. Soc.* 80, 1339-1339 (1958).

[26]. Kim, F. et al. Self-Propagating Domino-like Reactions in Oxidized Graphite. *Adv. Funct. Mater,* 20, 2867-2873 (2010).

[27]. Li, D., Muller, M. B., Gilje, S., Kaner, R. B. & Wallace, G. G. Processable aqueous dispersions of graphene nanosheets. *Nat. Nanotech.* 3, 101-105 (2008).

What is claimed is:

1. A method for forming a lubrication material, the method comprising:

providing a lubricant base fluid;

adding crumpled graphene balls as additives in the lubricant base fluid;

sonicating the lubricant base fluid with the additives for a sonicating time period, so that the crumpled graphene balls are self-dispersed in the lubricant base fluid to improve friction and wear properties of the lubricant base fluid; and adding a dispersing agent in the lubricant base fluid to enhance stability of dispersion of the crumpled graphene balls in the lubricant base fluid, wherein the lubricant base fluid is a polyalphaolefin type-4 (PAO4) oil, and the dispersing agent is Triethoxysilane.

2. The method of claim 1, wherein a weight percentage of the crumpled graphene balls to the lubricant base fluid is in a range between 0.01% and 0.1%.

3. The method of claim 1, wherein the sonicating time period is about 30 minutes.

4. The method of claim 1, wherein the crumpled graphene balls are configured to stay stably dispersed in the lubricant base fluid between a first temperature and a second temperature, wherein the first temperature is lower than a room temperature, and the second temperature is higher than the room temperature.

5. The method of claim 4, wherein the first temperature is about −15° C. and the second temperature is about 90° C.

6. The method of claim 1, wherein the crumpled graphene balls are formed by isotropically compressing flat graphene-based sheets suspended in nebulized aerosol droplets during a solvent evaporation process.

7. A method of providing lubrication using the lubrication material formed by the method of claim 1.

8. A lubrication material, comprising:

a lubricant base fluid;

crumpled graphene balls being added as additives in the lubricant base fluid; and a dispersing agent being added in the lubricant base fluid to enhance stability of dispersion of the crumpled graphene balls in the lubricant base fluid, wherein the lubrication material is sonicated for a sonicating time period, so that the crumpled graphene balls are self-dispersed in the lubricant base fluid; and wherein the lubricant base fluid is a polyalphaolefin type-4 (PAO4) oil, and the dispersing agent is Triethoxysilane.

9. The lubrication material of claim 8, wherein a weight percentage of the crumpled graphene balls to the lubricant base fluid is in a range between 0.01% and 0.1%.

10. The lubrication material of claim 8, wherein the sonicating time period is about 30 minutes.

11. The lubrication material of claim 8, wherein the crumpled graphene balls are configured to stay stably dispersed in the lubricant base fluid between a first temperature and a second temperature, wherein the first temperature is higher than a room temperature, and the second temperature is lower than the room temperature.

12. The lubrication material of claim 11, wherein the first temperature is about −15° C. and the second temperature is about 90° C.

13. The lubrication material of claim 8, wherein the crumpled graphene balls are formed by isotropically compressing flat graphene-based sheets suspended in nebulized aerosol droplets during a solvent evaporation process.

14. A method of providing lubrication using the lubrication material of claim 8.

* * * * *